United States Patent [19]

Hartung et al.

[11] 4,322,168

[45] Mar. 30, 1982

[54] TWO-TUBE CONTINUOUS SAND MULLER

[75] Inventors: Rodney L. Hartung, Milford, Mich.; Dennis L. McCann, Letts, Iowa; Larry W. Uhre, Muscatine, Iowa; Richard P. Bergmann, Atalissa, Iowa; James A. Hostetter, Morning Sun, Iowa; Nicholas J. Konrad, Atalissa, Iowa

[73] Assignee: Carver Foundry Products, Muscatine, Iowa

[21] Appl. No.: 143,783

[22] Filed: Apr. 25, 1980

[51] Int. Cl.[3] ..... B28C 5/14

[52] U.S. Cl. ..... 366/15; 366/40; 366/64

[58] Field of Search ..... 366/14, 15, 33, 34, 366/40, 64, 154, 155, 156, 158, 291

[56] References Cited

U.S. PATENT DOCUMENTS

| | | | |
|---|---|---|---|
| 2,028,745 | 1/1936 | Hendrick et al. | 366/15 |
| 3,268,214 | 8/1966 | Higgs | 366/154 |
| 4,039,169 | 8/1977 | Bartholomew | 366/64 X |
| 4,174,906 | 11/1979 | Richard | 366/33 X |

*Primary Examiner*—Philip R. Coe

*Attorney, Agent, or Firm*—Price, Heneveld, Huizenga & Cooper

[57] ABSTRACT

A continuous sand muller for mixing foundry sand and binder additives includes a premixing tube and a primary mixing tube removably secured to a frame. The premixing tube includes a mixing auger and mixes sand and a catalyst. The primary mixing tube receives the mix from the premixing tube. A resin additive or other binder is fed to the primary mixing tube. A single, double shafted motor drives the primary mixing auger directly and the premixing auger through a timing belt drive. The mixed sand and binder is delivered by the primary mixing tube to an outlet. An access or cleanout cover is removably secured to the primary mixing tube.

12 Claims, 4 Drawing Figures

TWO-TUBE CONTINUOUS SAND MULLER

BACKGROUND OF THE INVENTION

This invention relates to foundry equipment and more particularly to a multi-tube continuous sand muller for mixing sand and binder materials to produce molds and/or cores.

Recently developed quick setting resin binder systems for sand molds or cores require only short working times and strip times. Such systems do not require baking for proper set. Although the quick setting feature is an important advantage production wise, it can create a serious problem in the maintenance of continuous muller equipment. Once the resin binder has been added to the sand, some of the resins tend to air-set without the addition of catalyst. When air-setting occurs, the sand/resin binder mixture may lump in the mixing tubes, creating variations in blending of materials, and even clogging of the equipment.

Commonly owned U.S. Pat. No. 4,039,169, entitled CONTINUOUS SAND MULLER and issued on Aug. 2, 1977, to Bartholomew discloses a continuous, three-tube sand muller which provides a pair of oppositely rotating premixing tubes and a main mixing tube. Sand and a binder additive are preblended in each of the premixing tubes, and the premixes from the two premixing tubes are combined and blended in a single, larger primary mixing tube. The completely blended materials are then deposited by the primary tube into a core box or mold. The mixing tubes are driven by a pulley and belt drive. The drive rotates the augers in the premixing tubes at the same rate, but counter-rotational to each other. The drive also rotates the primary mixing auger in the main or primary mixing tube at a controlled rate capable of receiving the full output of the two premixing augers.

Although a three-tube muller, as described in the aforementioned patent, is well adapted to handle most binder resin systems, the newer resin binders that tend to air-set without the presence of catalyst tend to create clogging problems in the premixing tubes. This can cause a buildup of materials in the premixing tubes as well as in the primary tube. Cleaning of the premixing tubes becomes more frequent, and accelerated wear problems may be experienced. In addition, some variation in the loads on any of the three mixing augers due to lumps in the materials, partial resin binder curing, or for any reason, can cause belt slippage, and further aggravate non-uniform mixing of materials.

U.S. Pat. No. 3,268,214, entitled COMBINED MIXER AND CONVEYOR UNITS and issued on Aug. 23, 1966, to Higgs also discloses a multi-tube muller or combined mixer and conveyor units. In one embodiment, a two-tube muller is disclosed. In another embodiment, a three-tube muller is disclosed. Multiple motors are used to drive the mixers.

Even though the three-tube mixer has proven to be an important advance over the prior single tube continuous mullers, and has solved many of the problems associated with the use of quick setting resin binder systems, there has been a need for further improvement in such equipment, particularly to solve the problems created by resin binders which tend to air cure.

SUMMARY OF THE INVENTION

In accordance with the present invention, a continuous muller is provided which substantially solves the problems heretofore experienced. Essentially, the muller includes a premixing tube and a main blending tube, both containing material mixing means, and having a single positive drive means for driving the respective mixing means at the same rate. Sand and catalyst materials are supplied into the upstream end of the premixing tube and are thoroughly mixed there as the materials move downstream to be transferred into the main mixing tube, where resin binder is added at the correct ratio. The complete mixture of materials is then thoroughly blended in the main mixing tube as the mixture moves downstream to be discharged into a core box or foundry mold.

The continuous muller in accordance with the present invention eliminates the second premixing tube assembly, decreases the residence time of the resin binder in the mixing tubes, increases efficiency and eliminates cleaning problems. Decreasing the residence time of the resin binder is particularly advantageous when using resin binders which tend to air cure.

Maintenance of the two-tube muller of the subject invention is further simplified because each mixing tube assembly is completely replaceable for convenient removal and cleaning. The premixing tube is substantially self-cleaning because no resin binder is added to that portion of the system. Clogging problems in the main mixing tube associated with air curing of resin binder are also minimized because of the much shorter residence time of the resin binder in the system.

DETAILED DESCRIPTION OF THE PREFERRED EMBODIMENT

Figure 1:
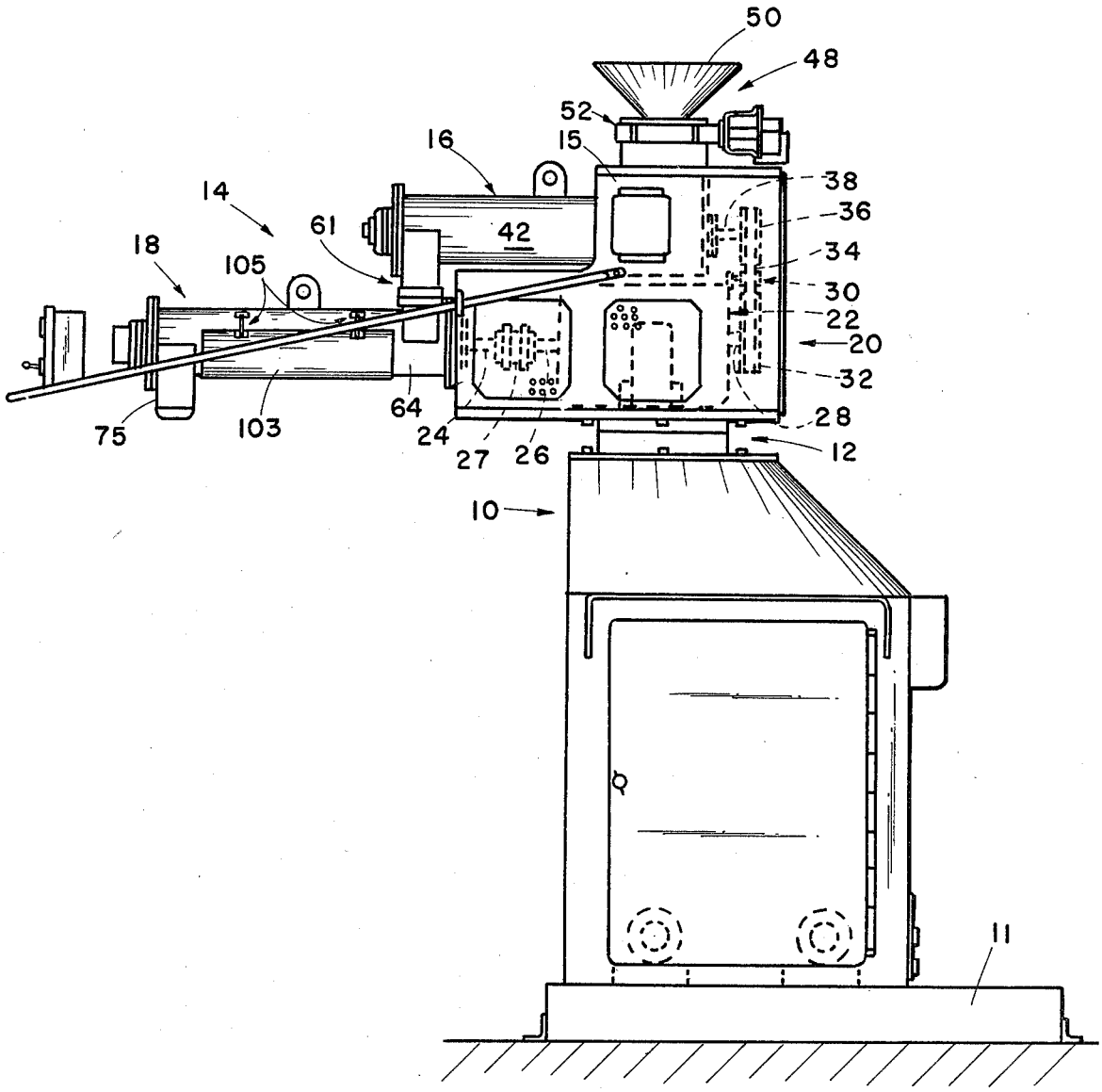
FIG. 1 is a side elevation of a mixing head and support assembly in accordance with the present invention.

As shown in FIG. 1 of the drawings, a continuous muller in accordance with the present invention includes a support pedestal 10 secured to a suitable foundation 11. A turntable 12 is provided on the top horizontal surface of the support pedestal. A mixing head assembly 14 is mounted on the turntable assembly 12.

The mixing head assembly 14 includes a frame weldment 15 supporting a horizontal premixing or preblending tube assembly 16, and an interconnecting primary mixing or final blending tube assembly 18 disposed below and extending horizontally outwardly from said premixing tube assembly 16.

Figure 3:
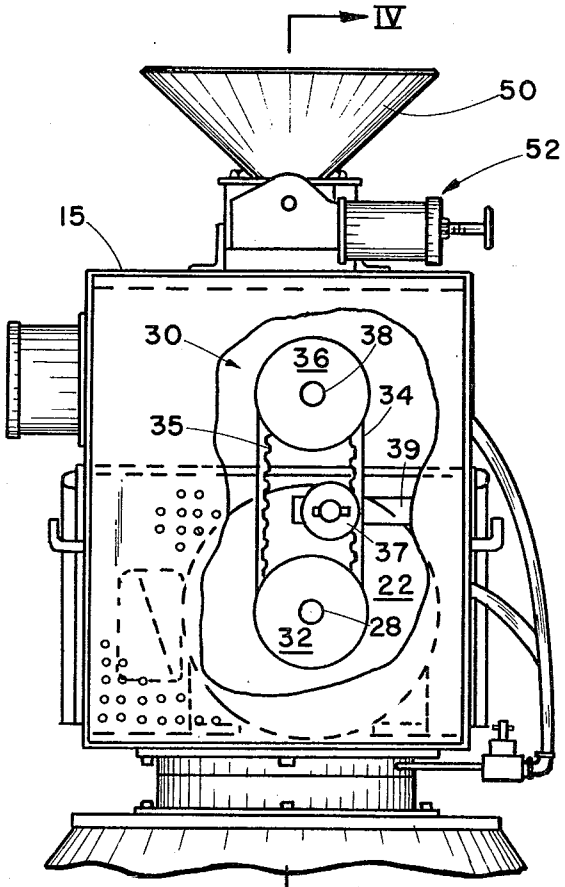
FIG. 3 is a rear elevation of the mixing head subassembly.
Figure 4:
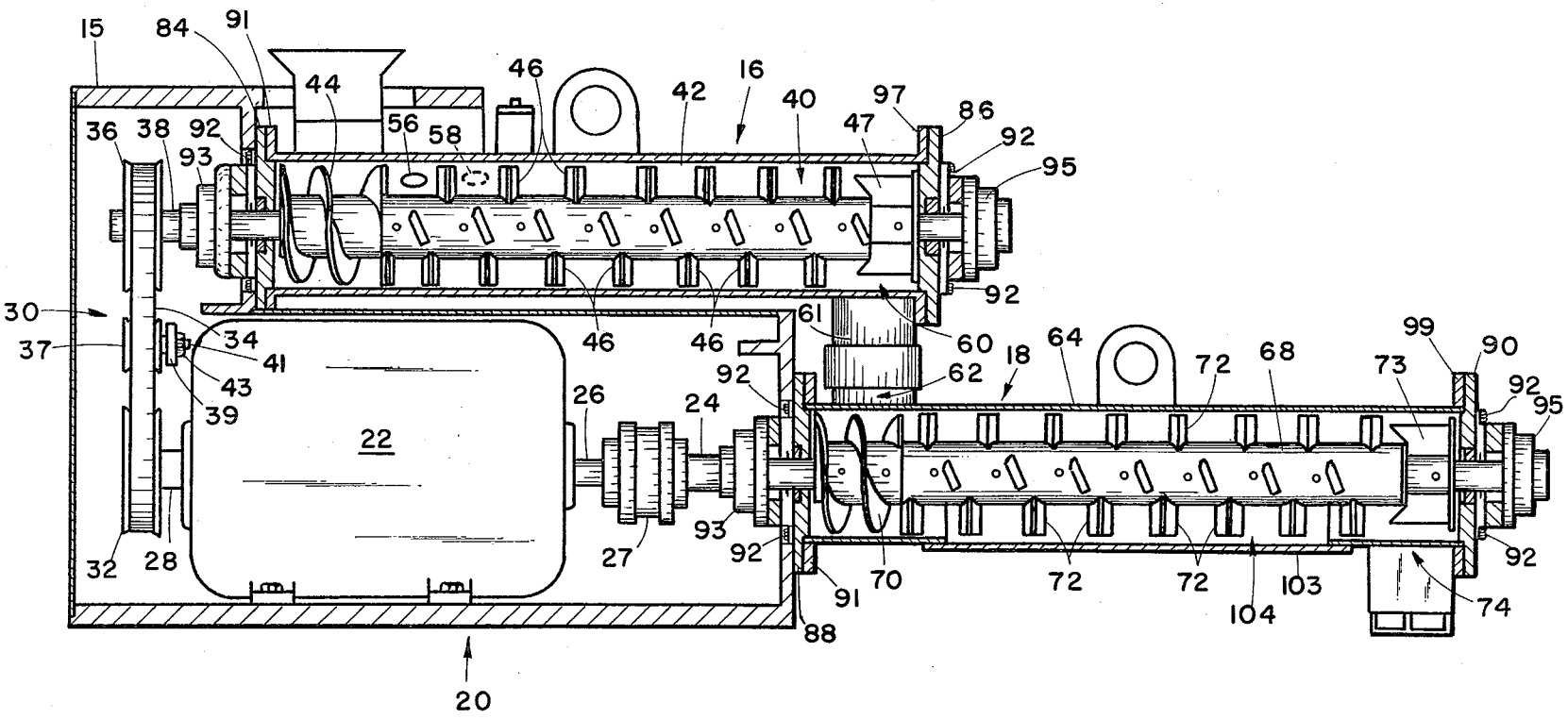
FIG. 4 is a side, partial cross-sectional view of the mixing head subassembly taken generally along line IV-IV of FIG. 3.

An electric drive motor assembly 20 is disposed beneath the premixing tube assembly 16. As seen in FIG. 4, the motor assembly is directly connected to a main drive shaft 24 of the primary blending tube assembly by means of first motor shaft 26 and a coupling 27. Drive motor 22 is a double shafted motor having a second motor shaft 28 extending horizontally from the opposite end thereof. A timing belt drive assembly 30 includes a motor shaft sprocket or pulley 32 mounted on the outer end of the second motor shaft 28. A timing belt 34 mounted on the motor shaft pulley 32 drives a second driven sprocket or pulley 36 mounted on a drive shaft 38 of the premixing tube assembly 16. Belt 34, as seen in FIG. 3, is a gear belt or timing belt having teeth 35 thereon which engage complementary configured teeth defined by pulleys 32, 36. An idler sprocket or pulley 37 is adjustably mounted on a support 39 (FIGS. 3 and 4). Pulley 37 engages belt 34 and is shiftable to tension the belt. As seen in FIG. 4, pulley 37 includes a shaft 41 extending through a slot in member 39. Pulley 37 is held in position by a nut 43. Belt 34 positively engages the pulleys and drives them with high efficiency and without any slippage.

Figure 2:
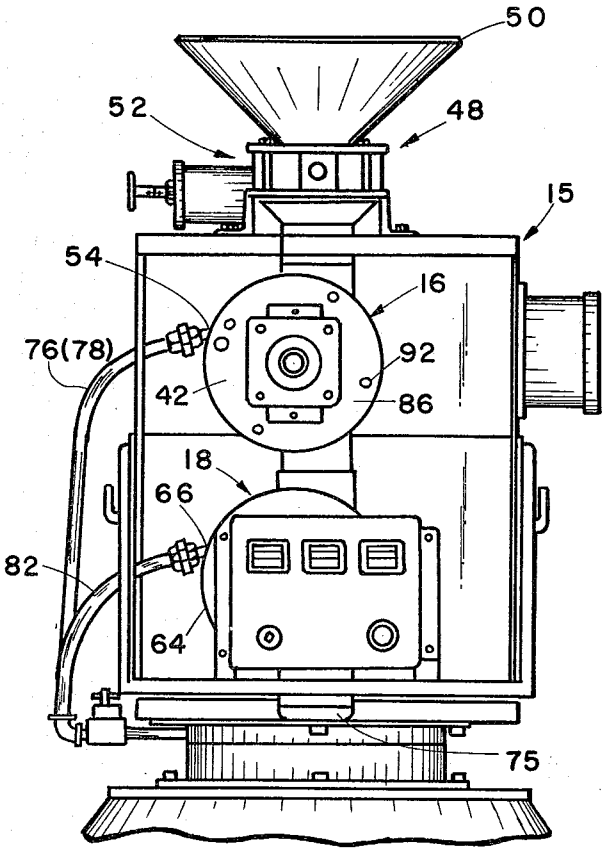
FIG. 2 is a front elevation of the mixing head subassembly.

As shown in FIG. 4, premixing tube assembly 16 includes a high intensity auger subassembly 40 rotatably mounted in a premix sleeve or tube 42. The auger assembly 40 includes a plurality of auger flights 44, paddles 46 and an outlet slinger 47 keyed to drive shaft 38 and rotatably driven therewith. Premixing tube assembly 16 also includes a sand inlet assembly 48 at the upstream end thereof (FIGS. 1, 2 and 4). The sand inlet assembly 48 includes a sand inlet hopper 50 and a sand supply metering valve 52 for regulating the flow of sand into the premix tube 42. The auger assembly is of the type described in U.S. Pat. No. 4,039,169, the disclosure of which is hereby incorporated by reference.

Also disposed at the upstream end of premixing tube assembly 16 is a binder additive inlet means 54 (FIG. 2) which may comprise one or several inlets 56 and 58 (FIG. 4) for supplying binder additives to the premix tube 42 to be blended with sand supplied thereto through the sand inlet assembly 48.

The premix tube 42 is provided with an outlet 60 at its downstream end which communicates through a transfer tube 61 with an inlet 62 at the upstream end of primary blending tube 64. Adjacent the inlet 62 and communicating with the upstream end of the primary blending tube 64 is an inlet 66 (FIG. 2) for supplying resinous material to the mixture of sand and binder additives entering the primary blending tube 64 from the premix tube 42.

Primary blending tube assembly 18 also includes a high intensity auger assembly 68 rotatably mounted in primary blending sleeves or tube 64. The auger assembly 68 includes a plurality of auger flights 70, paddles 72 and a slinger 73 keyed to the main drive shaft 24 of the primary blending tube assembly 18 and rotatably drive therewith. Primary blending tube assembly 18 further includes an outlet 74 and outlet tube 75 at its downstream end through which the completely blended mixture of sand, additives and resinous material is fed to a core box or mold.

Suitable feed conduit 76 (and, optionally, 78) supply additives to the premix tube 42 through binder additive inlet 54 from tanks with pumping means (not shown) which may be disposed in the support pedestal 10. An additional feed conduit 82 interconnects a supply tank with pumping means (not shown) to the resinous material inlet 66 to supply resinous material to the primary blending tube 64. This latter supply tank and pumping means may also be disposed in the support pedestal 10.

Various conventional sand resin binder systems may be mixed in the subject mixing head assembly, including no-bake furan, phenol formaldehyde, polymer isocyanate or oil urethane binder systems. The subject two-tube continuous muller is particularly well suited to handle the new three chemical system such as the PEP-SET system available from Ashland Chemical Company, Ashland, Kentucky. That system includes a polymer isocyanate binder and a catalyst which may be added through binder inlets 56 and 58 of the premix tube 42, and phenol formaldehyde/phenolic resin, which may be added through inlet 66 of the primary blending tube.

Control means for the drive motor 22, the sand supply metering valve 52, and the feed conduits 76, 78 and 82 may be of the general type disclosed in the aforementioned U.S. Pat. No. 4,039,169, the disclosure of which has been incorporated by reference, but modified as necessary to adapt the system to the two-tube continuous muller of the subject invention.

In an alternate embodiment, the two-tube continuous muller of the subject invention may be pivotally mounted on a conveyor assembly substantially similar to the conveyor assembly shown in FIG. 1 of U.S. Pat. No. 4,039,169. As shown therein, a turntable mounting means may be provided for limited rotational movement of the mixing head assembly. The other end of the conveyor assembly shown in the patent is adapted to be pivotally mounted on the support pedestal 10 through the turntable-type assembly 12. The sand inlet hopper 50 and sand supply metering valve are relocated to the inner end of the conveyor assembly over the support pedestal 10.

It is preferred that a recirculating binder additive system substantially as shown in FIG. 13 of U.S. Pat. No. 4,039,169 be employed in the present two-tube continuous muller. The distribution lines for binder additives would be connected as described above through feed conduits 76 (and, optionally, 78) to supply additives through additive inlet means 54 (through inlets 56 and, optionally, 58). The distribution line for resinous material connects through feed conduit 78 and inlet 66 at the upstream end of the primary blending tube 64 to supply resinous material to the upstream end of the primary blending tube 64. It is preferred that the control system be modified to include another off delay timer to control the "off delay" of the additive so that the last sand in the upper tube 16 receives binder additive before the pumping system switches to recirculation when the machine is shut off.

A second premix tube, such as that shown in U.S. Pat. No. 4,039,169 has been elminated in the subject apparatus because the primary blending tube 64 provides the locus for mixing the preblended additives and sand from the premix tube with the resinous material entering the primary blending tube through inlet 66. Maintenance and cleaning of the apparatus is significantly reduced because there is less transit time for the resinous material. This is especially important when resinous materials are used which tend to air cure.

As best seen in FIGS. 2 and 4, premixing tube assembly 16 and primary blending tube assembly 18 are secured to weldment 15 by removable mounting plates 84, 88, respectively, and a plurality of attachment bolts 92. Plates 84, 88 are bolted or otherwise secured to an end flange 91 on each sleeve 42, 64. Each of the assemblies can be removed for cleaning and maintenance or replacement with a minimum of downtime. Shafts 24 and 38 are rotatably supported by bearing assemblies 93 at the inlet ends to the tubes. Bearings 93 are secured to mounting plates 84, 88. The opposite ends of shafts 24, 38 are similarly supported by bearing assemblies 95 secured to mounting plates 86, 90, respectively. Plates 86, 90 are each secured to end flanges 97, 99 of sleeves 42, 64, respectively, by bolts 92.

As a result, the sleeves or tubes 42, 64, auger subassemblies 40, 68 and shaft support bearings are removable as a unit by loosening of mounting plates 84, 88. With prior continuous muller, such as shown in U.S. Pat. No. 4,039,169, the entire mixing subassemblies were not removable as a unit. With the present invention, the user can keep an extra mixing assembly in stock. By merely removing bolts 92 holding plate 88 to frame 15, the lower assembly can be removed as a unit without disassembly and replaced with the one from stock. The removed assembly can be cleaned as time permits with minimal downtime for the muller. This permits a not insignificant increase in total production and eases plant maintenance.

Also, as best seen in FIGS. 1 and 4, primary mixing assembly 18 includes a removable access cover or cleanout door 103 covering an elongated aperture 104. Door 103 is held to tube 64 by connectors or latches 105 positioned at longitudinally spaced points on sleeve or tube 64. Since catalyst is introduced into upper assembly 16 and resin or binder into the lower tube, build up of material should occur only or primarily within lower tube assembly 18. Access door 103 covering aperture 104, provides for easy cleaning of the lower assembly without removal from the weldment.

The two-tube, high intensity continuous muller of the subject invention provides a further improvement in continuous mulling apparatus, particularly suitable for handling sand/additive/resin mixes in which the resinous material has a tendency to preset. The single, double shafted drive motor with a timing belt drive ensures a complete and uniform supply of materials to the system. The drive eliminates slippage which can occur with conventional belt drive systems. The drive also represents a significant cost savings since multiple motors and associated controls are eliminated. The drive also results in increased reliability and ease of maintenance. Maintenance and cleaning are greatly facilitated by means of the removable and replaceable premix and primary blending tubes.

The embodiments of the invention in which an exclusive property or privilege is claimed are defined as follows:

1. A continuous sand muller for mixing foundry sand and binder additives for core and mold production, said muller comprising:

a frame;

premixing means removably secured to said frame for mixing sand and a binder catalyst additive, said premixing means including an elongated sleeve defining a sand inlet at one end and an outlet at the other end, a high intensity auger means rotatably mounted within said sleeve for blending and continuously conveying a sand and additive mixture from the inlet to the outlet, and a binder catalyst additive inlet means on said sleeve for feeding said binder catalyst additive to said premixing means;

mounting means engaging said frame for removably mounting said premixing means to said frame so that said premixing means may be removed from said frame as a unit and without disassembly;

primary mixing means removably secured to said frame for receiving the premixed sand and binder catalyst additive mixture and mixing same with a binder resin additive, said primary mixing means including an elongated primary sleeve having a primary inlet at one end and a primary outlet at the other end, said primary inlet being positioned below said outlet of said premixing means to receive the mixture from said premixing means, a binder resin additive inlet means on said primary sleeve for feeding a resin additive to said primary mixing means, a high intensity primary auger means within said sleeve for continuously mixing said premixed sand and binder catalyst additive mixture with said binder resin additive and conveying said mixture to said primary outlet, and means for rotatably mounting said primary auger means within said sleeve;

another mounting means engaging said frame for removably mounting said primary mixing means to said frame so that said primary mixing means may be removed from said frame as a unit without disassembly; and drive means on said frame for positively rotating said auger means of said premixing means and said primary auger means at the same volumetric rate, said means for rotatably mounting said primary auger means comprising a pair of mounting plates carried by said primary sleeve, one at each end thereof, said primary auger means including an elongated shaft; and a pair of bearing assemblies, each secured to one of said mounting plates and rotatably receiving said elongated shaft, said another mounting means removably securing one of said mounting plates to said frame.

2. A continuous sand muller as defined by claim 1 wherein said primary sleeve defines an elongated aperture and said primary mixing means further includes a cleanout cover removably secured to said primary sleeve to cover said elongated aperture.

3. A continuous sand muller as defined by claim 2 wherein said drive means comprises:

a double shafted motor having a pair of aligned output shafts, coupling means for directly coupling one of said output shafts to one of said premixing means and primary mixing means; and timing belt means driven by the other of said output shafts for operatively engaging and rotating the other of said premixing means and primary mixing means at the same rate as said one of said premixing means and primary mixing means.

4. A continuous sand muller as defined by claim 3 wherein said another mounting means further includes a plurality of removable fasteners.

5. A continuous sand muller as defined by claim 4 wherein said timing belt means comprises:

a drive pulley secured to the other of said output shafts;

a driven pulley secured to said other of said premixing means and primary mixing means; and a gear belt connecting said drive pulley and said driven pulley.

6. A continuous sand muller as defined by claim 1 wherein said drive means comprises:

a double shafted motor having apair of aligned output shafts, coupling means for directly coupling one of said output shafts to one of said premixing means and primary mixing means; and timing belt means driven by the other of said output shafts for operatively engaging and rotating the other of said premixing means and primary mixing means at the same rate as said one of said premixing means and primary mixing means.

7. A continuous sand muller for continuously mixing foundry sand with binder additives, said muller comprising:

a frame;

a single preblending means removably secured to said frame for continuously mixing sand and an additive mixture and for conveying said mixture to an outlet;

mounting means for detachably mounting said preblending means to said frame;

a single primary blending means on said frame for receiving said mixture, mixing same with another binder additive and for continuously conveying said mixture to a primary outlet;

another mounting means for removably mounting said primary blending means to said frame so that said primary blending means can be removed from said frame as a unit without disassembly; and single drive means on said frame and operatively connected to said single preblending means and said primary blending means for positively driving said preblending means and said primary blending means, said single drive means including a driven sprocket and a drive sprocket, each secured to one of said single preblending means and said single primary blending means, a gear belt engaging said driven sprocket and said drive sprocket, and an electric motor having a pair of aligned output shafts, one of said shafts directly coupled to one of said preblending means and said primary blending means and the other of said shafts having said drive sprocket secured thereto.

8. A continuous sand muller as defined by claim 7 wherein primary blending means comprises:

an elongated, cylindrical sleeve defining an inlet aperture at one end and an outlet aperture at the other end, said sleeve further having a flange at each end;

a high intensity auger means within said cylindrical sleeve for continuously conveying and mixing said mixture, said auger means including an elongated shaft;

a pair of mounting plates, each secured to said flanges; and bearing means on said mounting plates for rotatably supporting said elongated shaft.

9. A continuous sand muller as defined by claim 8 wherein said another mounting means comprises a plurality of removable fasteners securing one of said mounting plates to said frame.

10. A continuous sand muller as defined by claim 9 wherein said elongated cylindrical sleeve defines a cleanout aperture and said primary blending means further includes a cleanout cover removably secured to said sleeve at said aperture.

11. A continuous sand muller as defined by claim 10 wherein said preblending means comprises:

an elongated, cylindrical sleeve defining an inlet aperture at one end and an outlet aperture at the other end, said sleeve further having a flange at each end;

a high intensity auger means within said cylindrical sleeve for continuously conveying and mixing said mixture, said auger means including an elongated shaft;

a pair of mounting plates, each secured to said flanges; and a bearing means on said mounting plates for rotatably supporting said elongated shaft.

12. A continuous sand muller as defined by claim 11 wherein said mounting means comprises a plurality of removable fasteners securing one of said mounting plates of said preblending means to said frame with said outlet aperture of said preblending sleeve above said inlet aperture of said sleeve of said primary blending means.

* * * * *

UNITED STATES PATENT AND TRADEMARK OFFICE

CERTIFICATE OF CORRECTION

PATENT NO. : 4,322,168

DATED : March 30, 1982

INVENTOR(S) : Rodney L. Hartung et al

It is certified that error appears in the above-identified patent and that said Letters Patent is hereby corrected as shown below:

Column 3, line 45, "drive" should be --driven--.
Column 6, claim 6, line 56, "apair" should be --a pair--.
Column 8, claim 11, line 27, delete "a".

Signed and Sealed this

*Thirteenth* Day of *July 1982*

[SEAL]

*Attest:*

GERALD J. MOSSINGHOFF

*Attesting Officer*

*Commissioner of Patents and Trademarks*